US008528994B2

(12) United States Patent
Simmons et al.

(10) Patent No.: US 8,528,994 B2
(45) Date of Patent: Sep. 10, 2013

(54) DRAWER GLIDE ASSEMBLY FOR A DRAWER-TYPE DISHWASHER

(75) Inventors: Michael C. Simmons, Moscow, TN (US); Thomas J. Wuestefeld, Jackson, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 1741 days.

(21) Appl. No.: 11/501,003

(22) Filed: Aug. 9, 2006

(65) Prior Publication Data

US 2007/0247043 A1 Oct. 25, 2007

Related U.S. Application Data

(60) Provisional application No. 60/793,246, filed on Apr. 20, 2006.

(51) Int. Cl.
*A47B 77/06* (2006.01)

(52) U.S. Cl.
USPC ..... 312/228; 312/334.7; 312/334.4

(58) Field of Classification Search
USPC ..... 312/311, 228, 334.7, 334.4, 334.5, 312/350; 384/22; 248/298.1, 220.21, 220.22; 403/353
See application file for complete search history.

(56) References Cited

U.S. PATENT DOCUMENTS

| | | | | |
|---|---|---|---|---|
| 2,378,545 | A * | 6/1945 | Fraser et al. | 73/167 |
| 3,328,106 | A * | 6/1967 | Mullin | 312/334.7 |
| 4,440,461 | A * | 4/1984 | Powell et al. | 312/334.8 |
| 5,209,555 | A * | 5/1993 | Camilleri | 312/334.18 |
| 5,588,729 | A * | 12/1996 | Berger | 312/334.4 |
| 5,624,171 | A | 4/1997 | Soja et al. | |
| 5,632,542 | A * | 5/1997 | Krivec | 312/334.7 |
| 5,636,820 | A * | 6/1997 | Domenig | 248/220.21 |
| 5,671,986 | A * | 9/1997 | Vinet | 312/334.8 |
| 5,984,442 | A * | 11/1999 | Hellman, Jr. | 312/334.12 |
| 6,402,276 | B1 * | 6/2002 | King | 312/334.7 |
| 6,491,049 | B1 | 12/2002 | Tuller et al. | |
| 6,571,808 | B2 | 6/2003 | Todd | |
| 6,604,884 | B1 * | 8/2003 | Ohkura | 403/187 |
| 6,732,552 | B2 | 5/2004 | Kim et al. | |
| 2001/0035704 | A1 * | 11/2001 | Dierbeck | 312/902 |

(Continued)

FOREIGN PATENT DOCUMENTS

| | | |
|---|---|---|
| JP | 2001061746 | 3/2001 |
| JP | 2002028123 | 1/2002 |

(Continued)

*Primary Examiner* — Darnell Jayne
*Assistant Examiner* — Daniel Rohrhoff
(74) *Attorney, Agent, or Firm* — Jacquelyn R. Lin; Diederiks & Whitelaw PLC

(57) ABSTRACT

A drawer glide assembly for a drawer type dishwasher includes a mounting bracket having a top edge portion, a bottom edge portion and side portions that collectively define first and second opposing surfaces. The mounting bracket also includes a pad member that projects laterally outward from the first surface and a hook member that projects laterally outward from the second surface. The glide assembly further includes a drawer glide unit having a first rail member slidably interconnected with a second rail member through a third rail member. The mounting bracket serves as an interface between a tub of the dishwasher and an outer housing. That is, the mounting bracket is supported upon the outer housing by the hook member and the glide assembly is secured to both the tub and the first surface. In this fashion, the tub can be readily shifted into and out from the outer housing.

11 Claims, 6 Drawing Sheets

(56) References Cited

U.S. PATENT DOCUMENTS

| | | | | |
|---|---|---|---|---|
| 2004/0007952 | A1 | 1/2004 | Domenig et al. | |
| 2004/0056570 | A1 | 3/2004 | Schessl et al. | |
| 2004/0085005 | A1* | 5/2004 | Nakano et al. | 312/228 |
| 2004/0200508 | A1 | 10/2004 | Jung et al. | |
| 2004/0244825 | A1 | 12/2004 | Ashton | |
| 2005/0212390 | A1 | 9/2005 | Silvestro et al. | |
| 2005/0225219 | A1* | 10/2005 | Chen et al. | 312/334.5 |
| 2006/0066189 | A1* | 3/2006 | Bond et al. | 312/319.1 |
| 2006/0066190 | A1 | 3/2006 | Hay | |

FOREIGN PATENT DOCUMENTS

| | | | |
|---|---|---|---|
| JP | 2002065570 | | 3/2002 |
| JP | 2002209828 | | 7/2002 |
| JP | 2003000515 | | 1/2003 |
| JP | 2003159205 | | 6/2003 |
| JP | 2004097261 | | 4/2004 |
| JP | 2007050168 | A * | 3/2007 |
| WO | 00/16681 | A1 | 3/2000 |
| WO | 03/016802 | A1 | 2/2003 |

* cited by examiner

DRAWER GLIDE ASSEMBLY FOR A DRAWER-TYPE DISHWASHER

CROSS-REFERENCE TO RELATED APPLICATION

The present application claims the benefit of U.S. Provisional Patent Application Ser. No. 60/793,246 filed Apr. 20, 2006 entitled "Drawer Glide Assembly For a Drawer-Type Dishwasher."

BACKGROUND OF THE INVENTION

1. Field of the Invention

The present invention pertains to the art of dishwashers and, more particularly, to drawer glide mounting assembly for a drawer-type dishwasher.

2. Discussion of the Prior Art

Manufacturers employ a variety of techniques to slidably support a drawer in a cabinet. In the art of dishwashers, manufacturers typically employ a multi-piece drawer glide. With this arrangement, a first or stationary piece of the drawer glide is affixed to the cabinet, while a second or sliding piece of the drawer glide is affixed to the drawer. A third or intermediate piece interconnects the first piece with the second piece allowing the drawer to fully extend relative to the cabinet.

During manufacture, the stationary piece is initially mounted to the cabinet and the sliding piece mounted to the drawer. Once fully secured, the drawer is then installed into the cabinet. While this method has proven effective, often times when securing the stationary piece, vertical tolerances accumulate. Thus, in order to ensure that the drawer operates smoothly, steps are generally taken to permit adjustments to at least the stationary pieces so that they not only extend parallel to one another but also lie in substantially the same plane. Typically, the adjustments are provided in structure utilized to secure the stationary pieces to the cabinet. That is, each stationary piece includes mounting apertures that are sized slightly larger than a corresponding mechanical fastener employed to mount the drawer glide. In this manner, each stationary piece can be shifted or repositioned in order to ensure that the drawer has a smooth transition between open and closed positions. Unfortunately, adjusting the glides adds time and complexity to the manufacturing process and, over time, often requires re-adjusting to ensure continued proper drawer operation.

Based on the above, despite the presence of drawer glides in the prior art, there still exists a need for a mounting arrangement for a drawer glide for a drawer-type dishwasher. More specifically, there exists a need for a drawer glide that requires little or no adjustment to accommodate any vertical tolerance accumulation.

SUMMARY OF THE INVENTION

The present invention is directed to a drawer glide assembly for a drawer-type dishwasher including an outer housing having at least top and opposing side wall portions and a tub. The tub includes front, rear, bottom and opposing side walls that collectively define a washing chamber. The glide assembly slidingly supports the tub within the outer housing. More specifically, the glide assembly is secured to corresponding ones of the side walls of the tub and the side wall portions of the outer housing in a manner which allows the tub to be selectively shifted into and out from the outer housing.

In accordance with the invention, the glide assembly includes a mounting bracket having a top edge portion, a bottom edge portion and side portions that collectively define first and second opposing surfaces. The mounting bracket also includes a pad member that projects laterally outward from the first surface and a hook member that projects laterally outward from the second surface. The glide assembly further includes a drawer glide unit having a first rail member slidably interconnected with a second rail member through a third rail member.

In further accordance with the invention, the first rail element is preferably positioned upon the pad member and secured to the first surface of the mounting member, while the second rail element is installed onto one of the opposing side walls of the tub. Once installed, the mounting member is connected to one of the opposing side wall portions of the outer housing. Actually, the opposing side wall portions of the outer housing are provided with openings positioned to receive the hook member so as to support the mounting bracket. That is, the mounting bracket is supported upon the outer wall portion by the hook member. Once in position, a mechanical fastener is employed to further secure the mounting bracket to the outer housing.

Preferably, the glide assembly includes two mounting members connected at spaced locations to the first rail element. Most preferably, the tub is supported to the outer housing through a pair of glide assemblies slidably interconnecting respective ones of the opposing side walls with corresponding ones of the opposing side wall portions of the outer housing. This construction simplifies construction of the dishwasher by substantially eliminating any vertical tolerance accumulation when mounting the tub to the outer housing.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
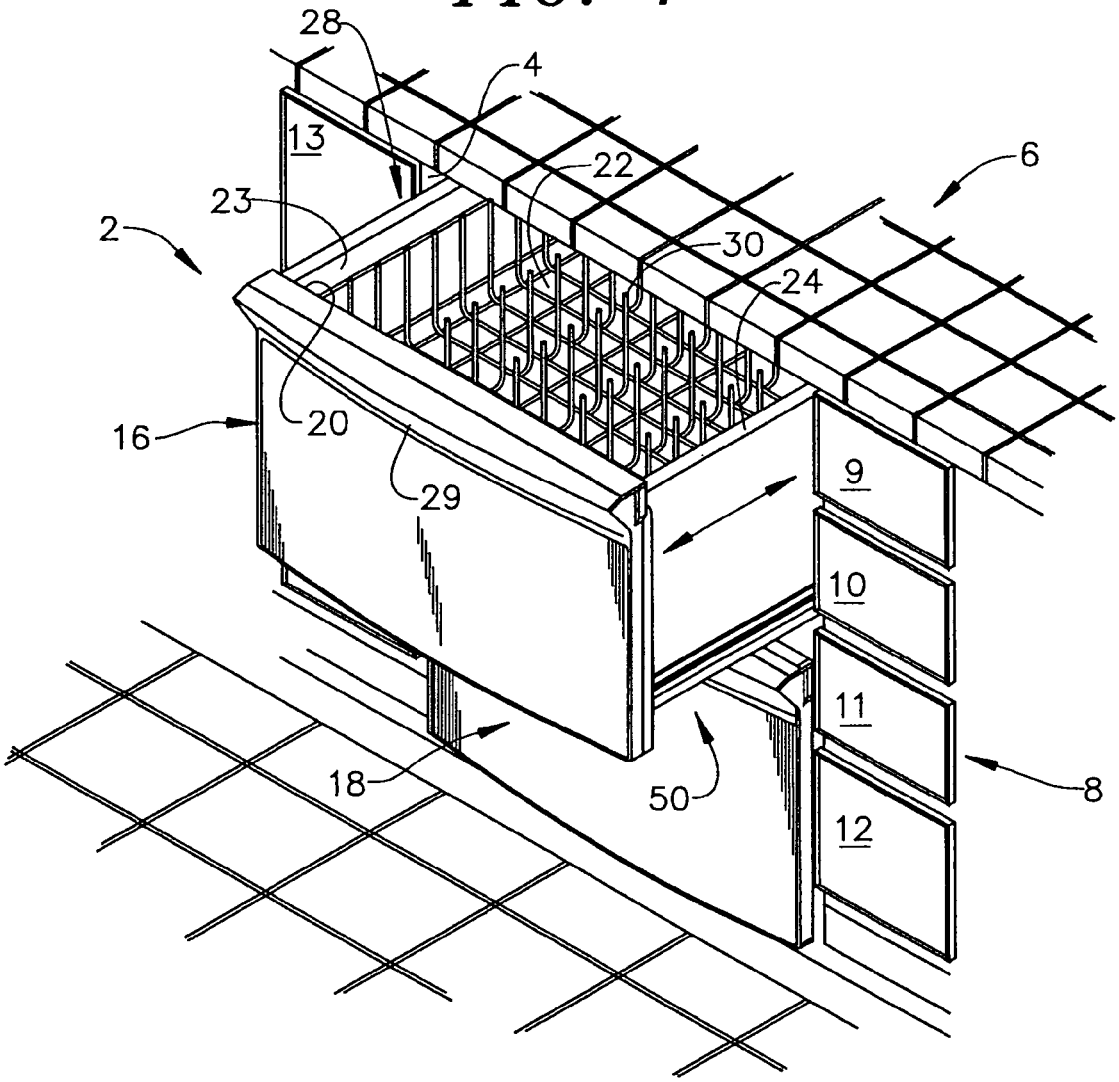
FIG. 1 is an upper right perspective view of a drawer-type dishwasher incorporating a glide assembly constructed in accordance with the present invention.
Figure 6:
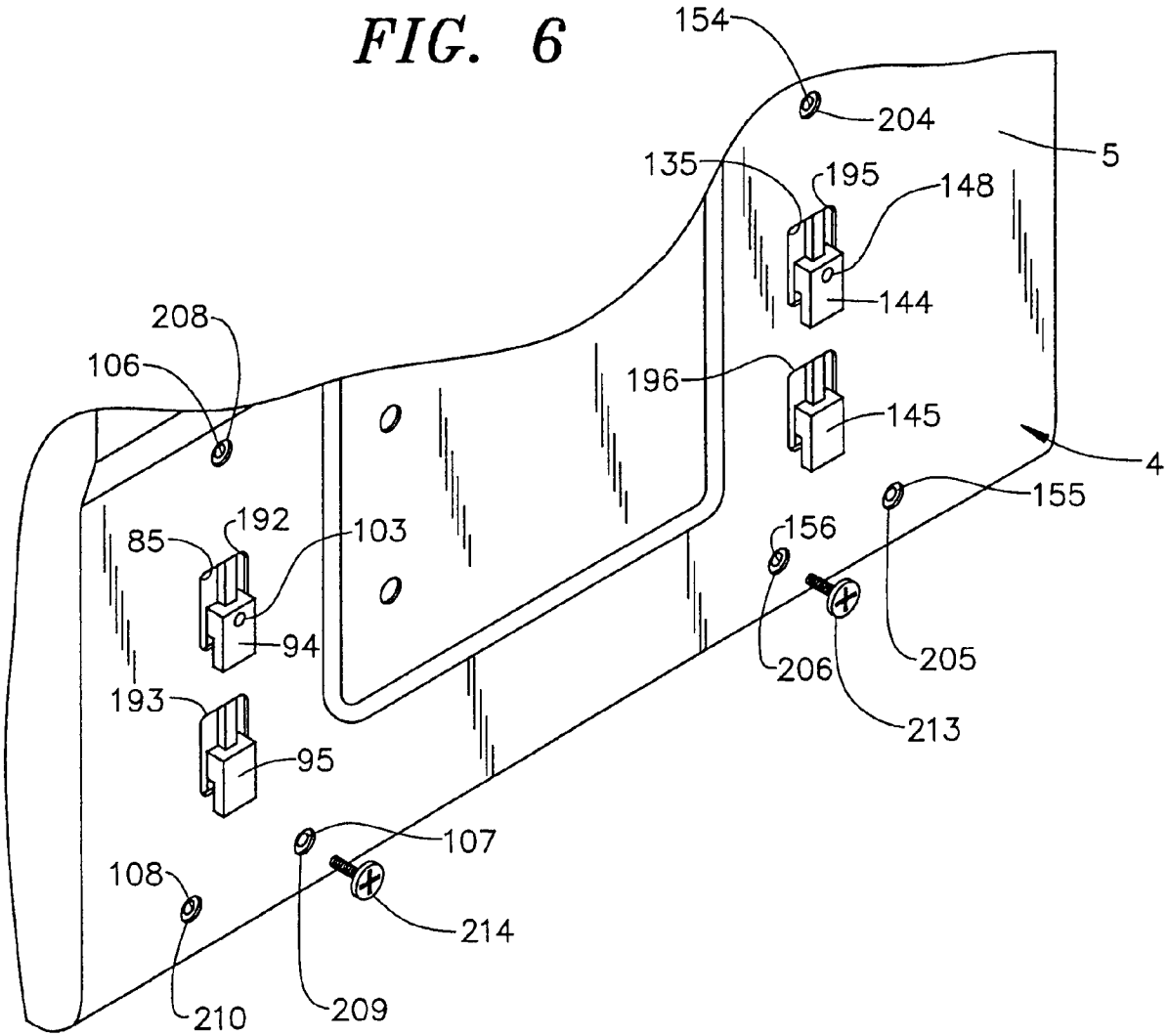
FIG. 6 is a partial, perspective view of the glide assembly shown mounted to an outer housing of the dishwasher.

With initial reference to FIG. 1, a dishwasher constructed in accordance with the present invention is generally indicated at 2. As shown, dishwasher 2 includes an outer housing 4 having a pair of opposing side wall portions, one of which is indicated at 5 in FIG. 6, arranged below a kitchen countertop 6. Also below kitchen countertop 6 is shown cabinetry 8 including a plurality of drawers 9-12, as well as a cabinet door 13. Although the actual dishwasher into which the present invention may be incorporated can vary, the invention is shown in connection with dishwasher 2 depicted as a dual cavity dishwasher having an upper washing unit or drawer 16 and a lower washing unit or drawer 18. As each drawer 16, 18 is substantially identical, a detailed description will be made with respect to drawer 16 with an understanding that drawer 18 is similarly constructed.

Figure 2:
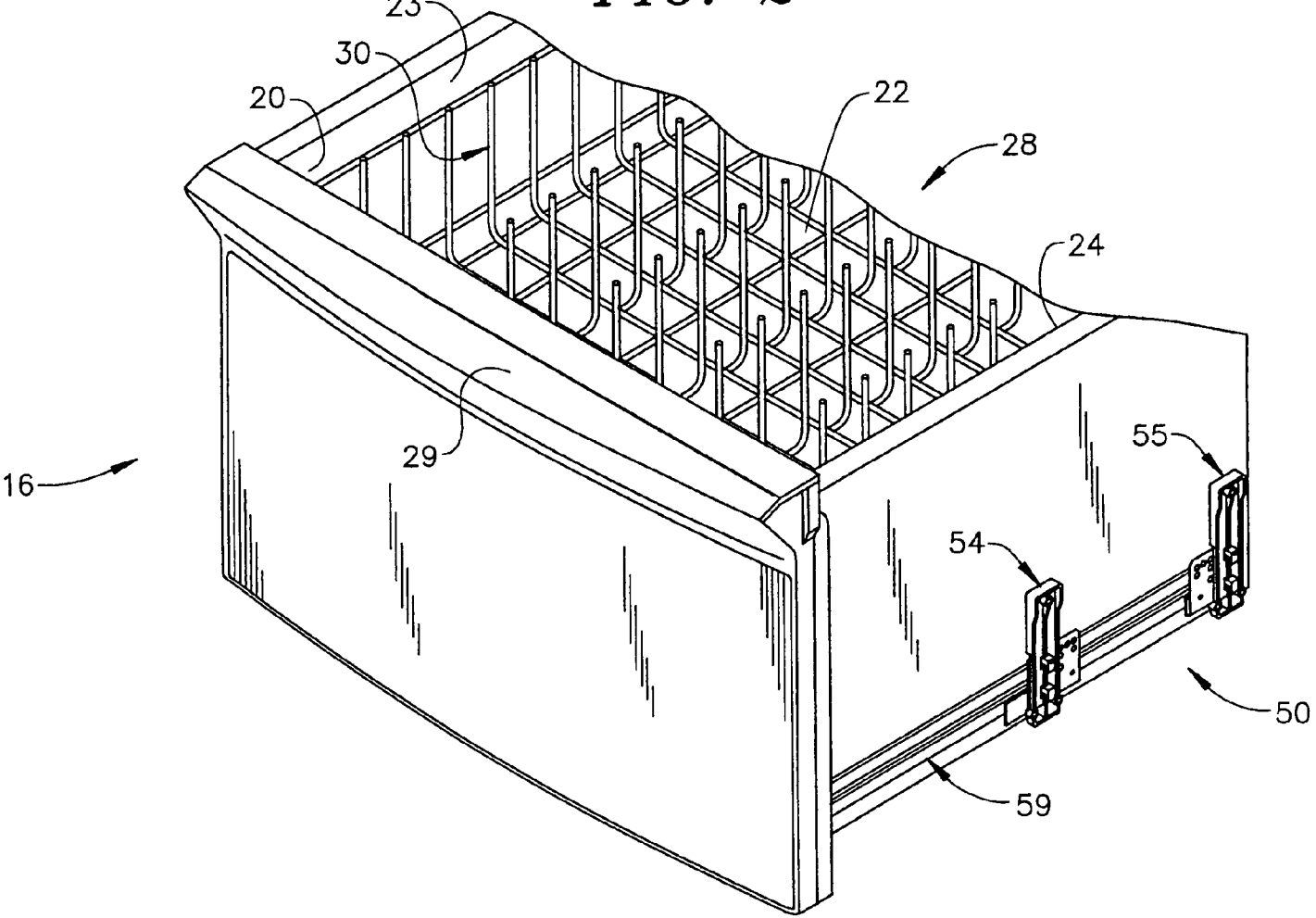
FIG. 2 is a upper right, partial perspective view of a tub portion of the dishwasher of FIG. 1 illustrating the glide assembly mounted in accordance with the present invention.

As best shown in FIGS. 1 and 2, drawer 16 includes a front wall 20, a rear wall (not shown), a bottom wall 22 and opposing side walls 23 and 24 that collectively define an upper wash chamber 28. In a manner known in the art, drawer 16 is provided with a handle 29 and a wire dish rack 30 for supporting various objects, such as dishware, glassware, and the like, during a washing operation. In general, the above-described structure does not form part of the present invention but is provided for the sake of completeness and to enable a better understanding of the figures. Instead, the present invention is directed to a glide assembly 50 that slidingly interconnects drawer 16 with outer housing 4.

Referring to FIGS. 2-6, glide assembly 50 includes a first mounting bracket 54, a second mounting bracket 55 and a drawer glide unit 59. As will be detailed more fully below, first and second mounting brackets 54 and 55 are secured to drawer glide unit 59 at spaced locations. Once secured, drawer glide unit 59 is attached to an inner surface of side wall 5 of outer housing 4. Although not shown, a second glide assembly is secured to an inner surface of an opposing side wall (not shown) of outer housing 4. As will be described more fully below, glide assembly 50 is also connected to outer surfaces of side walls 23 and 24 of drawer 16. With this construction, drawer 16 can be readily inserted into and removed from outer housing 4 allowing a consumer to load and unload dishware.

Figure 3:
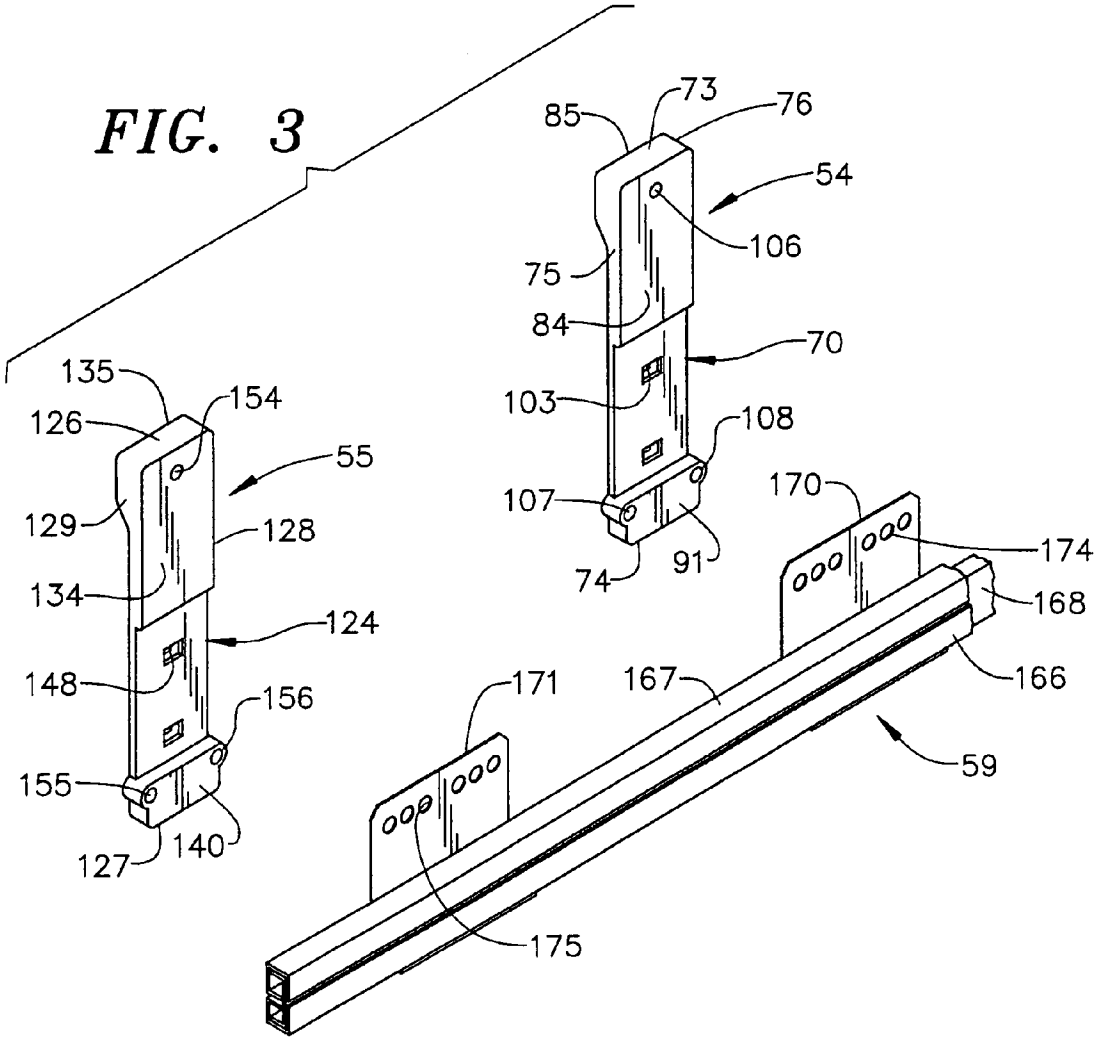
FIG. 3 is an exploded view of a pair of mounting members and a drawer glide unit portion of the glide assembly of FIG. 2.
Figure 5:
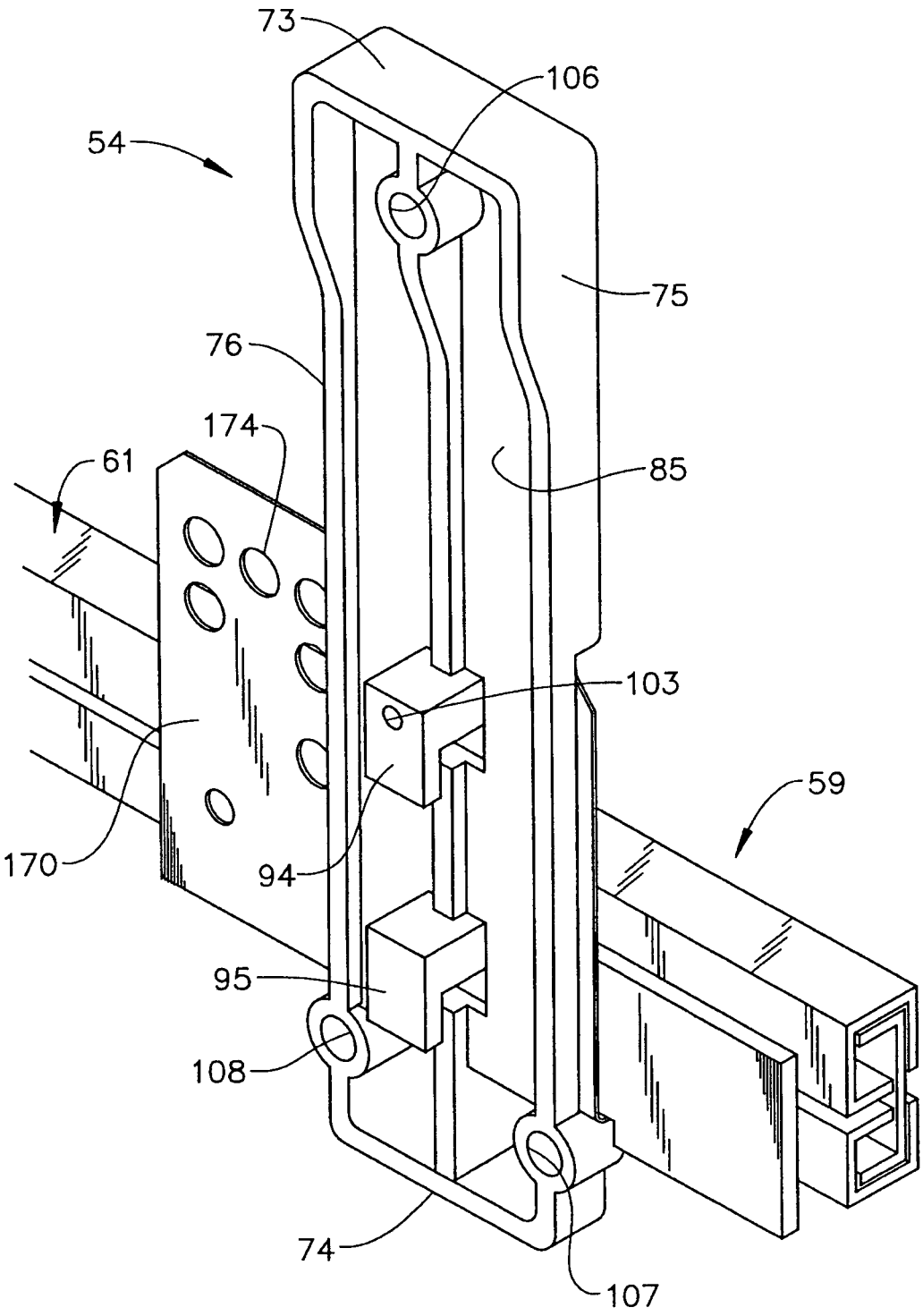
FIG. 5 is a rear perspective view of the glide assembly of FIG. 2.

Referring to FIGS. 3 and 5, first mounting bracket 54 is shown to include a main body portion 70 having atop edge portion 73, a bottom edge portion 74 and opposing side edge portions 75 and 76 that collectively define first and second opposing surfaces 84 and 85. First mounting bracket 54 also includes a pad member 91 that projects laterally outward from first surface 84, as well as a pair of hook members 94 and 95 that project laterally outward from second surface 85. Mounting bracket 54 further includes a mounting aperture 103 that extends through hook member 94, as well as a plurality of mounting holes 106-108 which extend through main body portion 70 and, along with hook members 94 and 95, are used in securing mounting bracket 54 to outer housing 5.

In a similar manner, mounting bracket 55 includes a main body portion 124 including a top edge portion 126, a bottom edge portion 127 and opposing side edge portions 128 and 129 that collectively define first and second opposing surfaces 134 and 135. In a manner also similar to that described above, mounting bracket 55 is provided with a pad member 140 that projects laterally outward from first surface 134, as well as pair of hook members 144 and 145 (see FIG. 6) that project outward from second surface 135. Mounting bracket 55 is also provided with a mounting aperture 148 that extends through hook member 144, as well as a plurality of mounting holes 154-156 which extend through main body portion 124 and, in combination with hook members 144 and 145, are used in securing mounting bracket 55 to opposing side wall portion 5.

Figure 4:
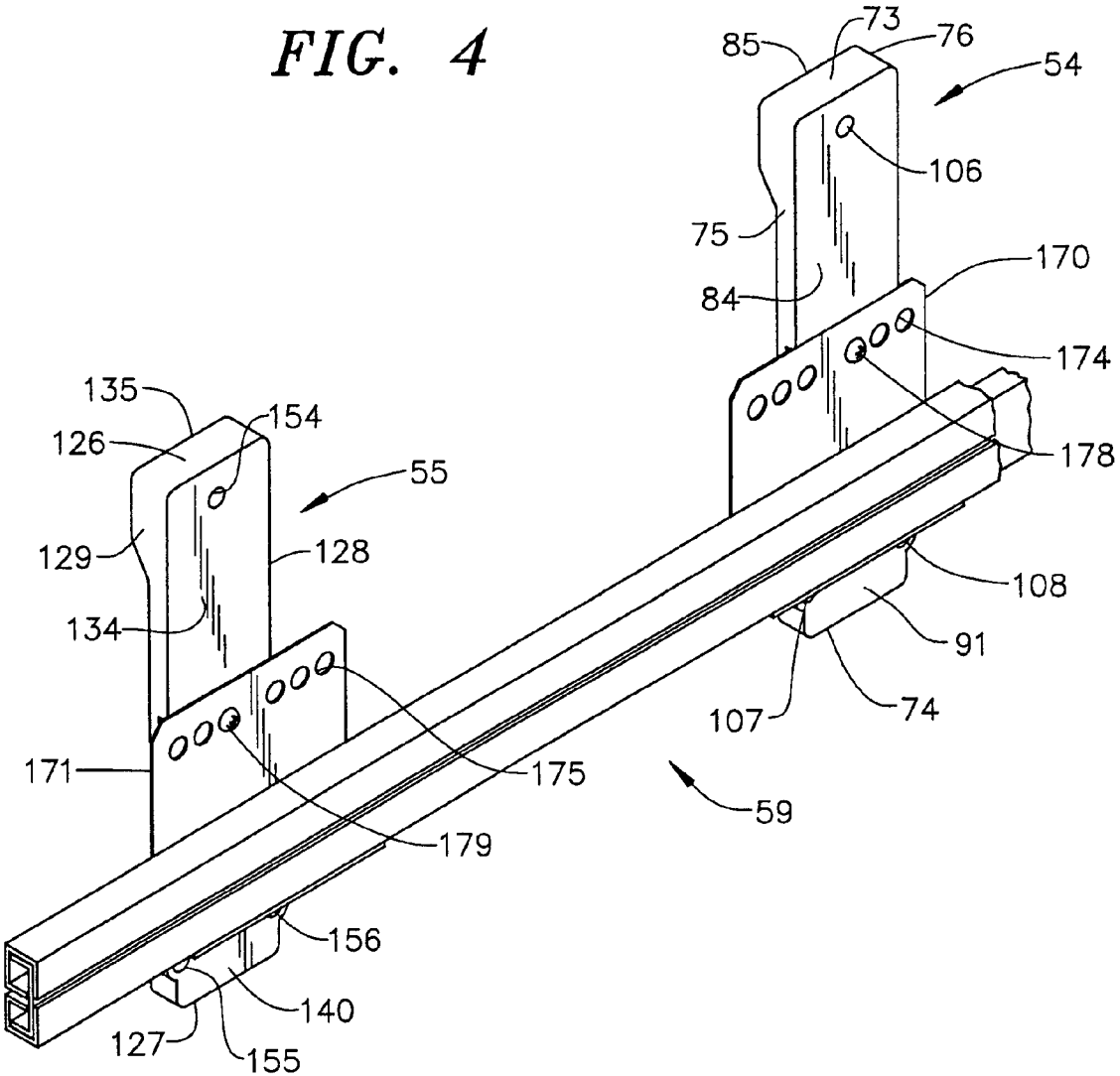
FIG. 4 is a front perspective view of the glide assembly of FIG. 2.

In accordance with the invention, drawer glide unit 59 includes a first or stationary rail member 166, a second or sliding rail member 167 that is preferably, slidingly interconnected to stationary rail member 166 through a third or intermediate rail member 168. As shown, drawer glide unit 59 also includes a pair of mounting plates 170 and 171, each having a plurality of openings indicated generally at 174 and 175 that are fixedly secured at spaced locations to stationary rail member 166. As best shown in FIG. 4, openings 174 and 175 are sized to receive mechanical fasteners 178 and 179 that extend through corresponding ones of mounting apertures 103 and 148 to secure glide unit 59 to mounting members 54 and 55. In the most preferred form of the invention, stationary rail member 166 is positioned so as to rest upon pad members 91 and 140 to ensure a preferred vertical alignment for drawer glide unit 59. Once installed, sliding rail member 167 is secured to, for example, side wall 24 of drawer 16 with, for example, mechanical fasteners in a manner known in the art. In this manner, intermediate rail member 168 serves as a sliding interface allowing drawer 16 to shift relative to cabinet 4. Again, it should be understood that a corresponding glide assembly (not shown) is secured to an outer surface of opposing side wall 23.

After drawer glide unit 59 is attached to mounting brackets 54 and 55 and rail member 167 to side wall 24, mounting brackets 54 and 55 are positioned into outer housing 4 with hooks 94, 95, 144 and 145 being inserted into corresponding hook receiving openings 192, 193, 195 and 196 formed in side wall portion 5. Actually, in addition to hook receiving openings 192, 193, 195 and 196, side wall portion 5 includes a plurality of apertures 204-206 and 208-210 that align with mounting holes 106-108 and 154-156 respectively. Once properly aligned, mechanical fasteners, such as shown at 213 and 214, are inserted through apertures 204-206 and 208-210 and engage with respective ones of mounting holes 106-108 and 154-156 to attached glide assembly 50. Once mounting brackets 54 and 55 are secured, rail member 167 is engaged with rail member 166 through intermediate rail member 168 to slidingly support drawer 16. Of course, it should be understood that a second glide assembly is mounted in a corresponding manner to the opposing side wall portion of outer housing 4 and side wall 23 such that drawer 16 can be readily, slidably inserted into and withdrawn from outer housing 4.

At this point, it should be understood that the present invention allows for a easily constructed glide assembly that reduces complexities associated with manufacturing a dishwasher unit by eliminating the need to provide vertical adjustment to glide assemblies for supporting a drawer in a drawer-type dishwasher. That is, by supporting stationary rail member 166 upon pads 91 and 140 prior to attachment to mounting brackets 54 and 55, a proper alignment can be maintained and, vertical tolerance accumulation substantially eliminated. Moreover, mounting bracket 54 and 55 ensure that drawer glide units 59 extends substantially parallel to and in the same plane as an opposing drawer glide assembly (not shown) mounted to an opposing side of drawer 16. Thus, once installed into outer housing 4, drawer 16 transitions smoothly into and out of outer housing 4. Finally, by eliminating the need for adjustments to glide assembly 50, the manufacturing ensures a proper alignment for drawer 16 over an entire service life of dishwasher 2.

Although described with reference to a preferred embodiment of the invention, it should be readily understood that various changes and/or modifications can be made to the invention without departing from the spirit thereof. In general, the invention is only intended to be limited by the scope of the following claims.

We claim:

1. A dishwasher comprising:

an outer housing having at least a top portion and one side wall portion;

a tub having front, bottom and opposing side walls that collectively define a washing chamber; and a glide assembly for mounting the tub for sliding movement into and out of the outer housing including:

a mounting bracket having a top edge portion, a bottom edge portion and side edge portions that collectively define first and second opposing surfaces, said mounting bracket including at least one hook member projecting laterally outward from the second surface and a mounting aperture extending between the first and second surfaces and through the hook member; and a drawer glide unit including a first rail member interconnected with a second rail member, said first rail member being positioned upon the mounting bracket and secured to the first surface with said second rail member being connected to one of the opposing side walls of the tub and slidably interconnected to the first rail member, said mounting bracket being connected to the at least one side wall portion through the at least one hook member in order to shiftably mount the tub to the outer housing.

2. The dishwasher according to claim 1, further comprising: a third rail member interconnecting the first rail member and the second rail member, said third rail member providing a sliding interface for the drawer glide unit.

3. The dishwasher according to claim 1, wherein the at least one hook member includes first and second hook members projecting laterally outward from the second surface.

4. The dishwasher according to claim 1, wherein the mounting bracket includes a pad member that projects laterally outward from the first surface, said first rail member being positioned upon the pad member.

5. The dishwasher according to claim 1, wherein the glide assembly includes first and second mounting brackets secured at spaced locations to the first rail member.

6. The dishwasher according to claim 1, wherein the drawer glide unit include a mounting plate secured to the first rail member, said mounting plate including at least one opening that aligns with the mounting aperture in the mounting bracket.

7. The dishwasher according to claim 6, wherein the drawer glide unit is secured to the mounting bracket with a mechanical fastener extending through the opening in the mounting plate and engaging with the mounting bracket through the mounting aperture.

8. The dishwasher according to claim 1, wherein the mounting bracket includes a plurality of mounting holes formed in the second surface.

9. The dishwasher according to claim 8, wherein the at least one side wall portion of the outer housing includes at least one hook receiving opening, said at least one hook member being adapted to extend through the at least one hook receiving opening to hang the glide assembly on the outer housing.

10. A dishwasher comprising:

an outer housing having at least a top portion and one side wall portion;

a tub having front, bottom and opposing side walls that collectively define a washing chamber; and a glide assembly for mounting the tub for sliding movement into and out of the outer housing including:

a mounting bracket having a top edge portion, a bottom edge portion and side edge portions that collectively define first and second opposing surfaces, said mounting bracket including at least one hook member projecting laterally outward from the second surface and a plurality of mounting holes formed in the second surface, wherein the outer housing includes a plurality of apertures formed in the at least one side wall portion, said apertures being aligned with the mounting holes of the mounting bracket; and a drawer glide unit including a first rail member interconnected with a second rail member, said first rail member being positioned upon the mounting bracket and secured to the first surface with said second rail member being connected to one of the opposing side walls of the tub and slidably interconnected to the first rail member, said mounting bracket being connected to the at least one side wall portion through the at least one hook member in order to shiftably mount the tub to the outer housing, wherein the at least one side wall portion of the outer housing includes at least one hook receiving opening, said at least one hook member being adapted to extend through the at least one hook receiving opening to hang the glide assembly on the outer housing.

11. The dishwasher according to claim 10, wherein the mounting bracket is secured to the outer housing through at least one mechanical fastener extending through one of the plurality of apertures in the outer side wall portion and engaging with the mounting bracket through one of the plurality of mounting holes.

* * * * *